US007079663B1

(12) United States Patent
Epping et al.

(10) Patent No.: US 7,079,663 B1
(45) Date of Patent: Jul. 18, 2006

(54) MICROPHONE

(75) Inventors: Heinz Epping, Neustand (DE); Manfred Bleichwehl, Hannover (DE); Artur Seehafer, Schwuelper (DE)

(73) Assignee: Sennheiser electronic GmbH & Co. KG, Wedemark (DE)

( * ) Notice: Subject to any disclaimer, the term of this patent is extended or adjusted under 35 U.S.C. 154(b) by 0 days.

(21) Appl. No.: 09/830,756

(22) PCT Filed: Oct. 16, 1999

(86) PCT No.: PCT/EP99/07869

§ 371 (c)(1),
(2), (4) Date: Nov. 27, 2001

(87) PCT Pub. No.: WO00/27165

PCT Pub. Date: May 11, 2000

(30) Foreign Application Priority Data

Oct. 30, 1998 (DE) ..... 198 50 298

(51) Int. Cl.
*H04R 25/00* (2006.01)

(52) U.S. Cl. ..... 381/355; 381/356; 381/357; 381/360

(58) Field of Classification Search ..... 381/322, 381/191, 173, 163, 356, 357, 338, 355, 345; 455/90; 29/594
See application file for complete search history.

(56) References Cited

U.S. PATENT DOCUMENTS

| | | | | |
|---|---|---|---|---|
| 3,513,270 | A | 5/1970 | Warning | |
| 3,585,317 | A | 6/1971 | Dvorsky | |
| 4,410,770 | A * | 10/1983 | Hagey | 381/177 |
| 5,148,492 | A * | 9/1992 | Uzawa et al. | |
| 5,781,644 | A * | 7/1998 | Chang | |

FOREIGN PATENT DOCUMENTS

| | | |
|---|---|---|
| DE | 37 08 747 | 9/1987 |

* cited by examiner

*Primary Examiner*—Suhan Ni
*Assistant Examiner*—Dionne Harvey
(74) *Attorney, Agent, or Firm*—Reed Smith LLP

(57) ABSTRACT

A microphone comprising a diaphragm which has a front diaphragm surface on which sound waves impinge and a rear diaphragm surface which is at least partially acoustically separated from the front diaphragm surface, and a sound inlet, through which sound waves can go to the rear diaphragm surface. In order to improve a strongly frequency-dependent frequency response characteristic in respect of the directional effect of the microphone, the microphone includes at least one damping element and the slot-shaped sound inlet forms substantially an acoustic inductance so that at least a part of the sound waves to be picked up is passed with a delay to the rear diaphragm surface.

13 Claims, 5 Drawing Sheets

MICROPHONE

CROSS-REFERENCE TO RELATED APPLICATIONS

This application claims priority of PCT Application Serial No. PCT/EP99/07869 filed Oct. 16, 1999 and German Application No. 198 50 298.2 filed Oct. 20, 1998, the complete disclosures of which are hereby incorporated by reference.

BACKGROUND OF THE INVENTION a) Field of the Invention

The invention concerns a microphone comprising a diaphragm which has a first diaphragm surface which is preferably towards a sound source and on which sound waves impinge and a second diaphragm surface which is at least partially acoustically separated from the first diaphragm surface, and which preferably faces away from the sound source, at least one, preferably slot-shaped, sound inlet, through which sound waves can go to the second diaphragm surface and which forms substantially an acoustic inductance so that at least a part of the sound waves to be picked up is passed with a delay to the second diaphragm surface, and at least one damping element.

b) Description of the Related Art

U.S. Pat. No. 3,585,317 A discloses such a microphone, in which an acoustic resistance is formed by the slot-shaped sound inlet, in order to damp the sound which passes through the slot-shaped sound inlet. The directional effect of the microphone can be influenced by the sound inlet between the air volume behind the diaphragm and the outside air. So that the slot-shaped sound inlet has the required acoustic impedance its width is small in relation to length. To achieve acoustic inductance, the slot-shaped sound inlet is provided with inserts of hardenable wax.

DE 22 17 051 also discloses a microphone which has a slot-shaped sound inlet to form an acoustic resistance. In that case, the sound inlet is in the form of a groove-shaped recess in the magnet system which is made from sintered material. In such a microphone the directional effect of the microphone is heavily frequency-dependent and can be used mostly only for low frequencies. Production of the corresponding slot-shaped sound inlets in the magnet system of sintered material requires special tools, and tuning of the directional effect by varying the slot-shaped sound inlet can be implemented only by replacing the entire magnet system.

OBJECT AND SUMMARY OF THE INVENTION

The object of the present invention is to develop a microphone of the kind set forth in the opening part of this specification, in such a way that it has a predetermined directional effect substantially over the entire frequency response curve or characteristic and in that respect its acoustic network is dependent substantially on the magnitude of the acoustic inductance and that of the damping element.

In a microphone of the kind set forth in the opening part of this specification, that object is attained in that the acoustic resistance which occurs in the sound inlet is less than the acoustic resistance of the damping element.

In such a microphone, the directional effect is achieved by a delay in the sound which passes in through the rear sound inlet. The delay in the sound is achieved by means of an acoustic network which has essentially an inductance formed by the slot-shaped sound inlet and a separate damping or attenuating element which forms an acoustic resistance.

The advantages of the invention are in particular that it implements a microphone with a directional effect which is constant substantially over the entire frequency range. In addition the acoustic network formed by the acoustic inductance and the damping element can be easily and precisely tuned so that the directional effect of the microphone can be predetermined within wide limits.

Admittedly, a parasitic acoustic resistance occurs in the sound inlet of the microphone according to the invention. In order however to make the acoustic network substantially dependent on the magnitude of the acoustic inductance and that of the separate damping element, the sound inlet in the microphone according to the invention is of such a configuration that the acoustic resistance which occurs in the sound passage is lower than the acoustic resistance of the damping element.

A preferred embodiment of microphone according to the invention provides that the damping element is formed by a sound passage which is provided with acoustic damping material and which connects a cavity to the volume delimited by the rear diaphragm surface. Tuning of the damping element is predetermined essentially by the size of the volume and the acoustic resistance of the sound passage which connects the cavity to the volume delimited by the rear diaphragm surface.

In a further preferred embodiment the sound inlet is of a substantially rectangular cross-section. That cross-sectional shape is easy to dimension in regard to the design of a microphone according to the invention and is easy to carry into effect in terms of manufacture. In that respect, the height of the sound inlet is particularly desirably smaller than its length, in which case the sound flow takes place along the longitudinal direction of the sound inlet and the length of the sound inlet is in turn smaller than the width thereof. The parasitic resistance of the sound inlet is held at a low level by virtue of the fact that the width of the sound inlet is large in relation to the length. In a desirable development the width of the sound inlet corresponds substantially to the periphery of the microphone. In that case, the sound inlet is interrupted only by support portions which are provided for the mechanical stability of the microphone and in particular the sound inlet. In this embodiment the sound inlet is thus formed not by narrow and long passages but by a substantially peripherally extending slot which has an only slight parasitic acoustic resistance and a predetermined acoustic inductance.

In a further preferred embodiment the diaphragm is connected to a diaphragm fixing portion. The diaphragm fixing portion serves to carry the diaphragm and to orient it by way of a suitable magnet system in such a way that an oscillating coil fixed to the diaphragm engages into an air gap provided in the magnet system.

In a further embodiment the microphone includes a closure element which is arranged in front of a mouth opening of the sound passage and which has an opening which substantially corresponds to the mouth opening of the sound passage and which is provided with the acoustic damping material. The closure element serves substantially to carry the acoustic damping material and to hold it in front of the mouth opening of the sound passage. The acoustic resistance of the damping element can be particularly advantageously changed by interchanging only the closure element and replacing it by another closure element with a different acoustic resistance. In that way microphone casings of the same structure can also be tuned differently by means of suitable closure elements.

In order to form the slot-shaped sound inlet through which sound waves can pass to the rear diaphragm surface, in a preferred embodiment of the microphone according to the invention the diaphragm fixing portion has an orifice which leads from the exterior to the rear diaphragm surface and which is substantially closed by a sealing element. In that arrangement the orifice is reduced by the sealing element to such an extent that the slot-shaped sound inlet is formed between the sealing element and the diaphragm fixing portion.

It is particularly advantageously possible in that way for the dimensions of the slot-shaped sound inlet to be predetermined by the sealing element which can be dimensioned and produced, independently of the diaphragm fixing portion. The microphone according to the invention can thus in turn be tuned in the desired manner by means of an inexpensive component which is simple to manufacture. There is therefore no longer any need for structural changes to the casing of the microphone or to other components which are to be manufactured with expensive tools. In that case, in a desirable development, the sealing element comprising a porous material and in particular a sintered material. Such material has a high level of internal damping which can improve the acoustic properties of the microphone and it can be easily put into a desired shape.

In a desirable development the cross-section of the slot-shaped sound inlet is essentially formed by a recess in the diaphragm fixing portion, the length of the sound inlet being essentially predetermined by the thickness of the sealing element. In that case, the sealing element is preferably of a substantially annular configuration and fits in an annular groove provided in the diaphragm fixing portion. The cross-section of the slot-shaped sound inlet can be predetermined in a simple fashion by the difference in size between the inside diameter of the diaphragm fixing portion and the outside diameter of the sealing element, in which case recesses do not have to be provided at the diaphragm fixing portion. That makes it possible to provide slots of different dimensions, with the same diaphragm fixing portion, insofar as only the annular sealing element is replaced by a different one involving a different outside diameter.

If however the slot-shaped sound inlet is completely closed by the sealing element, then only the damping element is effective and the directional characteristic of the microphone approaches a spherical shape. Therefore the microphone according to the invention also affords the possibility of embodying a microphone with a spherical directional characteristic, with the same design configuration and structure in respect of the microphone capsule. If a directional characteristic of that kind is to be implemented, then desirably the slot-shaped sound inlet can also be entirely omitted, in which case the other advantageous features described herein can nonetheless be provided in such an embodiment.

In a particularly desirable feature in that case the sealing element which substantially predetermines the size of the slot-shaped sound inlet is formed in one piece with the closure element which is arranged in front of the mouth opening of the sound passage and which carries the acoustic damping material. In that way, both the acoustic inductance by virtue of influencing the dimensions of the slot-shaped sound inlet and the acoustic resistance of the damping element by virtue of the choice of the acoustic damping material adopted can be particularly advantageously predetermined by means of a single component.

In an alternative embodiment the diaphragm fixing portion substantially surrounds the rear diaphragm surface and the sound inlet is formed between a holding portion provided on the diaphragm and the diaphragm fixing portion. The diaphragm fixing portion is essentially the portion of the diaphragm, with which the latter is connected to the diaphragm fixing portion. In a desirable development the holding portion is formed by a diaphragm ring connected to the diaphragm. Such a diaphragm ring advantageously enhances the stability of the diaphragm and can be easily manufactured. That is found to be advantageous in particular for the reason that, in a desirable development of the invention, provided in the diaphragm ring are recesses which substantially form the slot-shaped sound inlet. The diaphragm fixing portion can therefore have a substantially flat support contact surface for the diaphragm ring, wherein the dimensions of the slot-shaped sound inlet are predetermined by the recesses in the diaphragm ring. This embodiment also provides that the size of the slot-shaped sound inlet is formed by a component which is convenient in terms of manufacture so that, with identical diaphragm fixing portions, it is possible to provide for tuning of the microphone by altering the diaphragm ring.

In a further alternative embodiment the diaphragm according to the invention has a casing portion which is connected to the diaphragm fixing portion and which substantially encloses the rear diaphragm surface, in which case the sound inlet is formed between the diaphragm fixing portion and the casing portion.

Advantageous developments of the invention are characterized by the features of the appendant claims.

BRIEF DESCRIPTION OF THE DRAWINGS

The invention is described by way of example hereinafter with reference to the drawings in which.

DESCRIPTION OF THE PREFERRED EMBODIMENTS

Figure 1:
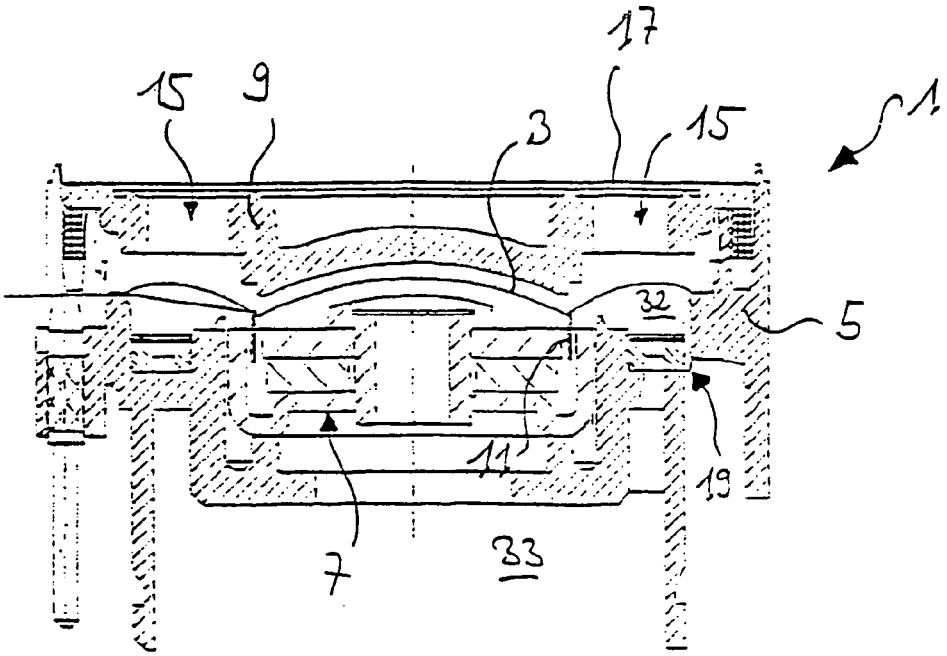
FIG. 1 shows a view in cross-section through a first embodiment of a microphone according to the invention.

FIG. 1 shows a first embodiment of a microphone according to the invention in cross-section, comprising a diaphragm 3, a diaphragm fixing portion 5, a magnet system 7 and a microphone cover 9. The diaphragm 3 is connected with its outer edge to the diaphragm fixing portion 5 and thereby centered over the magnet system 7. An oscillating coil 11 secured to the diaphragm 3 extends substantially transversely with respect to the diaphragm 3 into an air gap 13 in the magnet system 7. On its side towards the diaphragm 3 the microphone cover 9 is substantially matched to the contour of the diaphragm 3 and has a plurality of sound intake openings 15 through which sound to be picked up can impinge on the outside surface of the diaphragm 3. The sound intake openings 15 are covered by a sound-transmitting material 17 in order to protect the diaphragm from fouling and contamination, in particular dust and moisture.

Figure 2:
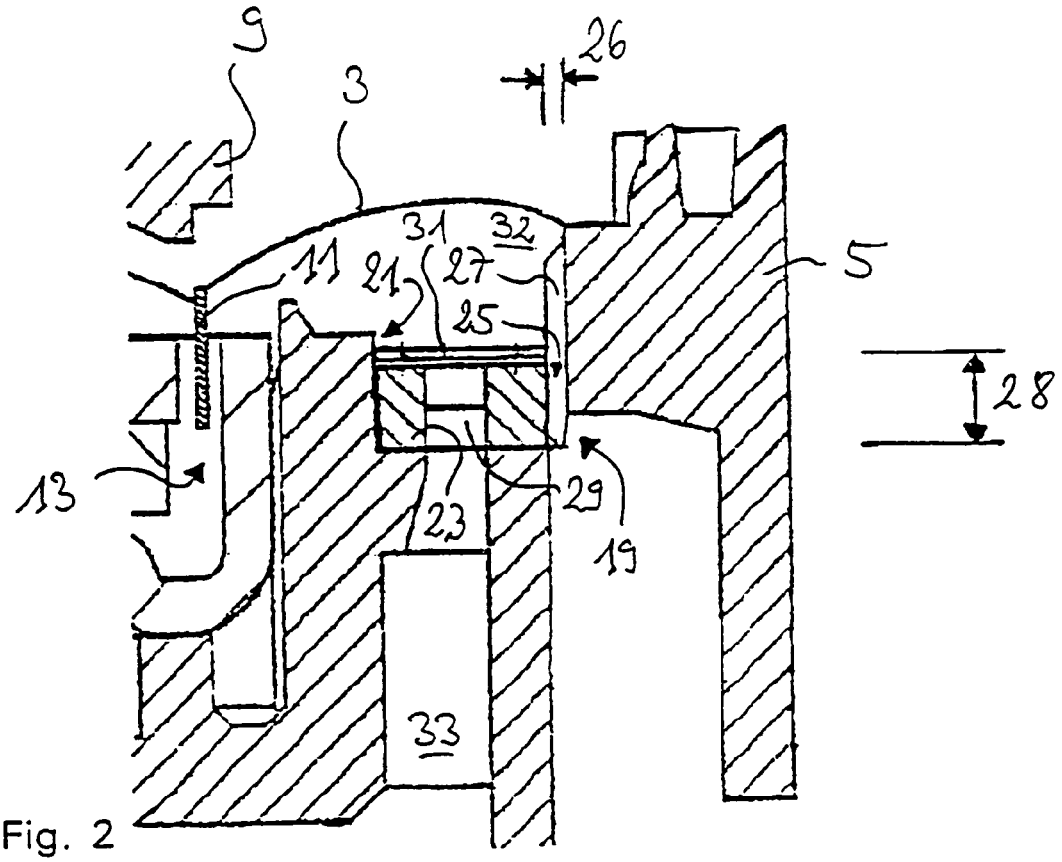
FIG. 2 is a view on an enlarged scale of a part of FIG. 1.

Also shown in FIG. 1 and in the detail in FIG. 2 is the diaphragm fixing portion 5 which has an orifice 19 leading from the exterior to the rear surface of the diaphragm 3. Provided in the diaphragm fixing portion is an annular groove 21, with the orifice 19 being provided in the annular groove 21 in the region of the edge between the bottom and the wall. Fitted in the annular groove 21 is a corresponding annular sealing element 23 which substantially closes the orifice 19 except for a slot-shaped sound inlet 25.

The acoustic properties of the microphone can be predetermined to a wide extent by varying the geometrical dimensions of the slot-shaped sound inlet 25. In the described embodiments, identified as the length 28 is that dimension of the sound inlet 25, along which the sound flow essentially passes. The width is essentially determined along the periphery of the microphone, and the height 26 of the sound inlet is defined by the spacing of two complementary components (5, 23; 5, 37; 5, 51) which delimit the sound inlet 25. Basically, in the illustrated embodiments of the invention, the height 26 of the sound inlet 25 is less than its length 28 and the length 28 of the sound inlet 25 is in turn less than the width thereof.

The height 26 (defined in the radial direction) of the slot-shaped sound inlet 25 as shown in FIGS. 1 and 2 is in this case essentially predetermined by a recess 27 provided in the diaphragm fixing portion 5 and the length 28 is predetermined by the thickness of the annular sealing element 23.

Provided on the annular sealing element 23 are ducts 29 which respectively form a sound passage, in a portion-wise manner. The ducts are provided with an acoustic damping material 31. The ducts 29 in the sealing element 23 connect the volume 32 delimited by the rear surface of the diaphragm 3 to a cavity 33 which is closed in an outward direction (not shown).

The cavity 33, together with the acoustic damping material 31 arranged in the ducts 29 in the sealing element 23, forms a damping element, wherein the acoustic damping value on the one side depends on the size of the cavity 33 while on the other side it depends on the acoustic properties of the ducts 29 and the damping material 31. The slot-shaped sound inlet 25 forms an acoustic inductance, the magnitude of which can be essentially predetermined by the geometrical dimensions involved. The acoustic inductance of the slot-shaped sound inlet 25, together with the damping element, forms an acoustic network which passes a part of the sound waves to be picked up, with a delay to the rear diaphragm surface.

Figure 3:
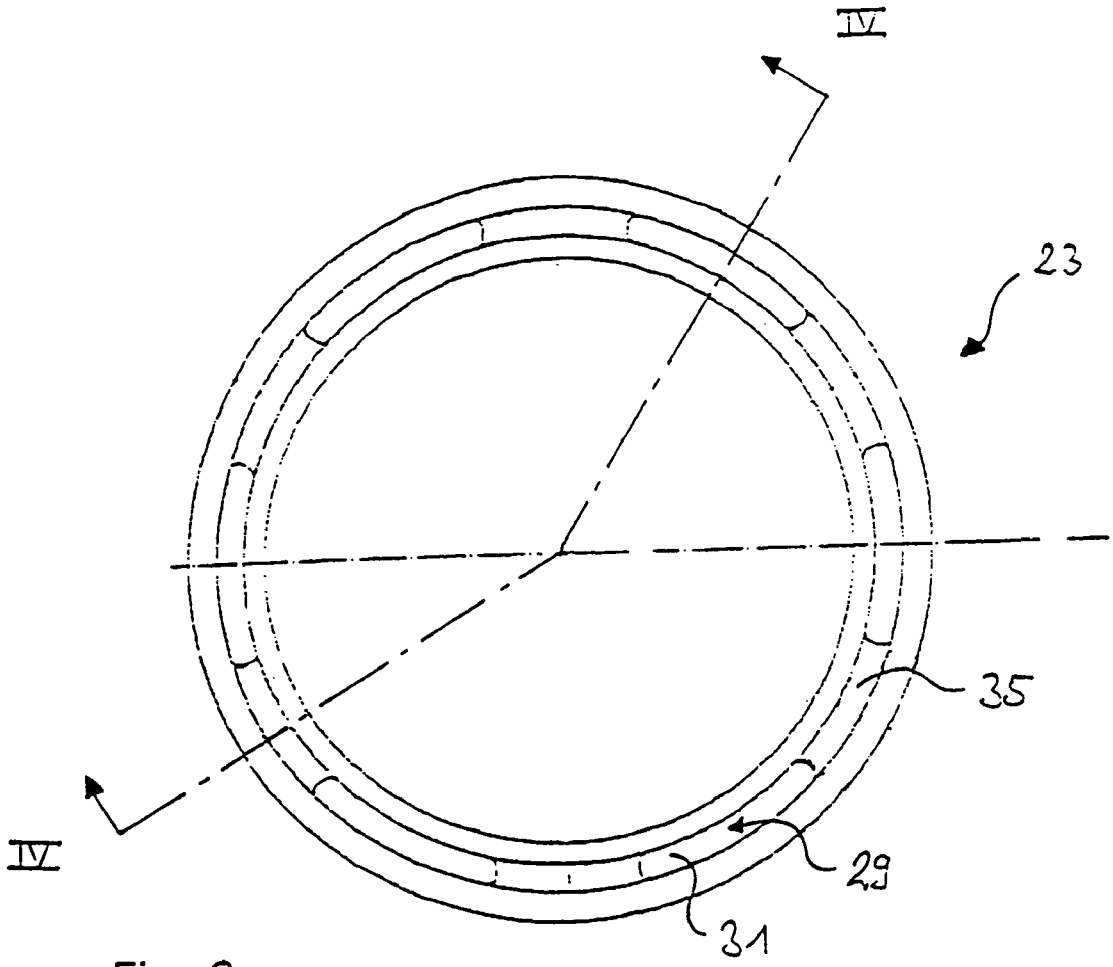
FIG. 3 shows a plan view of a sealing element which is fitted in the embodiment shown in FIG. 1.
Figure 4:
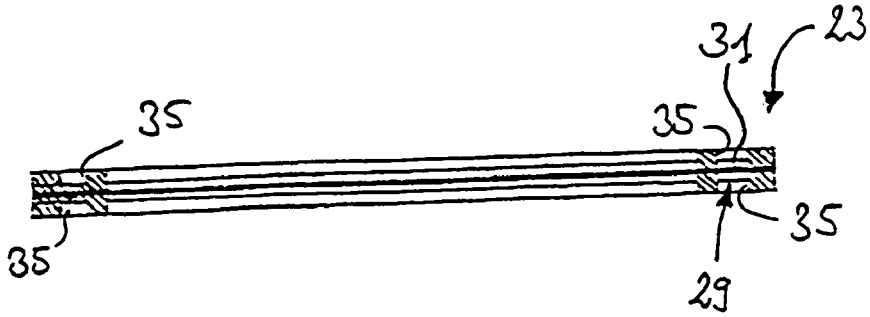
FIG. 4 shows a view in cross-section through the sealing element taken along line IV—IV in FIG. 3.

FIG. 3 shows an annular sealing element which is used for example in the first embodiment of the microphone as shown in FIGS. 1 and 2. FIG. 4 is a view of the annular sealing element in cross-section taken along line IV—IV in FIG. 3. The annular sealing element is of a substantially rectangular cross-section, with the sealing element 23 being provided with peripherally extending grooves 35 which are disposed in mutually opposite relationship on both sides. Provided in a portion-wise manner in the grooves 35 in the sealing element 23 are ducts 29 which are of the same width as the peripherally extending grooves 35 and which are substantially in the form of a slot. Arranged within the ducts 29 is an acoustic damping material 31 with which it is possible to predetermine the acoustic resistance of the ducts 29 in the sealing element 23.

Figure 5:
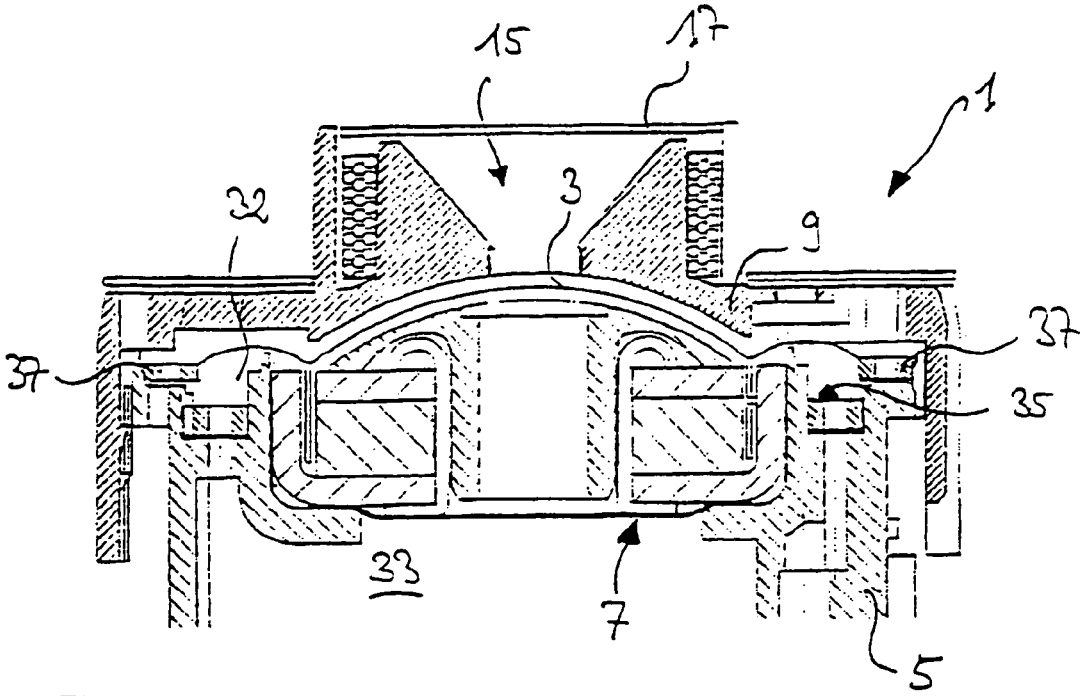
FIG. 5 shows a second embodiment of the microphone according to the invention.
Figure 6:
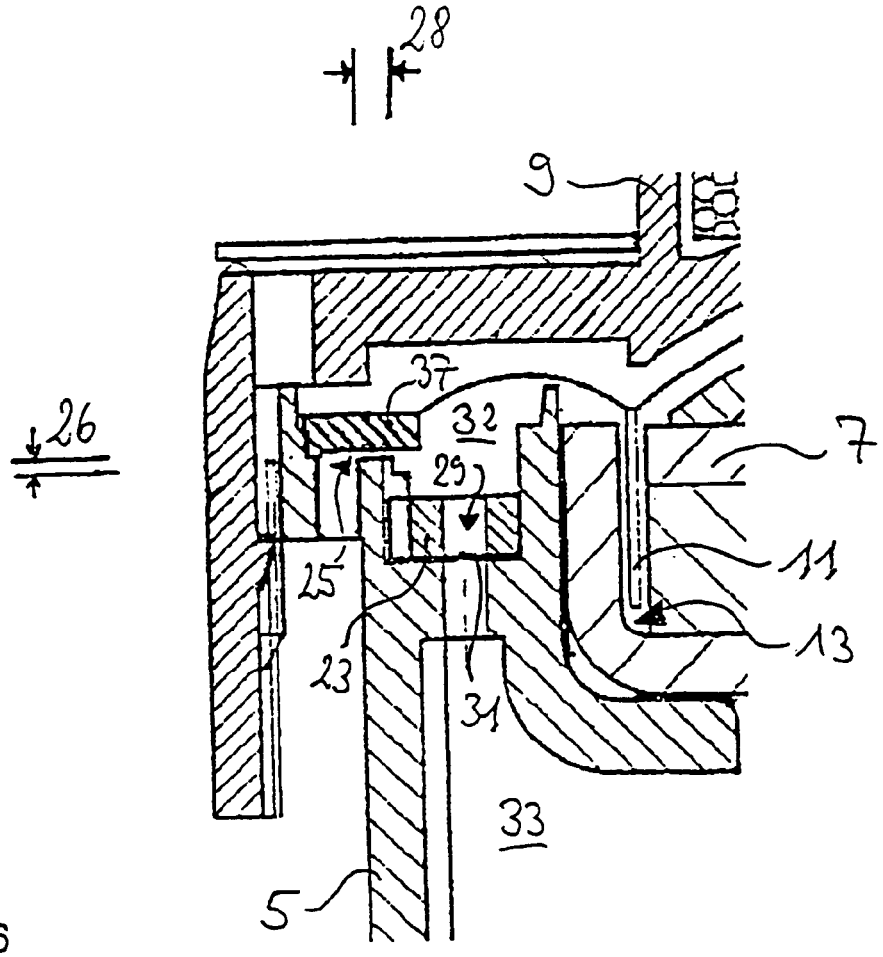
FIG. 6 is a view on an enlarged scale of a part of FIG. 5.

FIGS. 5 and 6 show a second embodiment of a microphone according to the invention, FIG. 5 showing a view in cross-section and FIG. 6 showing a view on an enlarged scale of part of FIG. 5. The microphone shown in FIGS. 5 and 6, like the microphone 1 in accordance with the first embodiment, also has a diaphragm 3, a diaphragm fixing portion 5 which carries the diaphragm 3, a magnet system 7, a microphone cover 9, an oscillating coil 11, an air gap 13 which is provided in the magnet system 7 and into which the oscillating coil 11 secured to the diaphragm 3 at least partially engages, and a sound intake opening 15 which is covered by a sound-transmitting material 17.

In contrast to the first embodiment, in the case of the microphone 1 in accordance with the second embodiment the rear surface of the diaphragm 3 is substantially enclosed by the diaphragm fixing portion 5. The diaphragm fixing portion 5 has an annular groove 21 in a volume 32 which is delimited by the rear surface of the diaphragm 3. An annular sealing element 23 is arranged in the annular groove 21. The sealing element 23 is provided with ducts which are disposed in opposite relationship to adjoining sound passages which are formed in the diaphragm fixing portion 5 and which connect a cavity 33 (not shown completely) which is also enclosed by the diaphragm fixing portion 5, to the volume delimited by the rear diaphragm surface. The annular sealing element carries acoustic damping material 31 with which the acoustic resistance of the damping element formed by the cavity 33 and the acoustic damping material 31 can be predetermined.

A diaphragm ring 37 of a substantially rectangular cross-section is secured to the outer, peripherally extending edge of the diaphragm 3. Formed between the diaphragm ring 37 and the diaphragm fixing portion 5, in a portion-wise manner, is a slot-shaped sound inlet 25 through which sound waves can pass to the rear diaphragm surface. The slot-shaped sound inlet 25 is formed by virtue of the diaphragm ring 37 having shallow recesses 39 at its surface which is towards the diaphragm fixing portion 5. In this case, the length of the slot-shaped sound inlet 25 is determined by the part of the diaphragm fixing portion 5, which is in opposite relationship to the shallow recess 39 of the diaphragm ring 37. The height 26 of the slot-shaped sound inlet 25 can be predetermined by the size of the recess 39.

Figure 7:
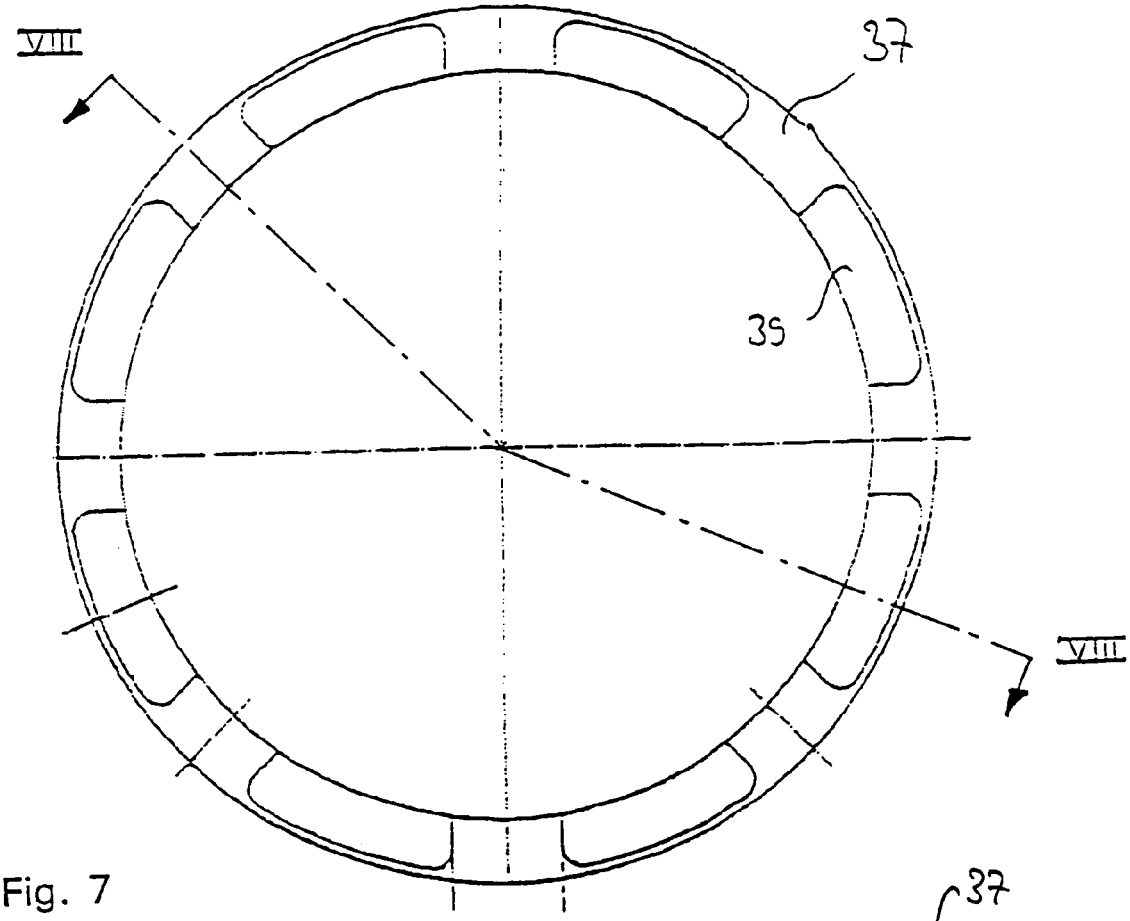
FIG. 7 is a plan view of a diaphragm ring which is fitted in the embodiment shown in FIG. 5.
Figure 8:
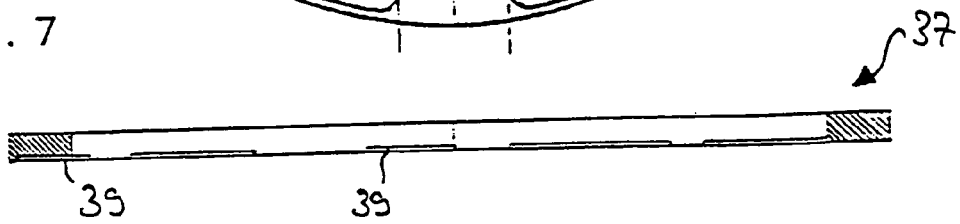
FIG. 8 is a view in cross-section of the diaphragm ring taken along line VIII—VIII in FIG. 7.

FIGS. 7 and 8 show a view in detail of a diaphragm ring according to the invention, more specifically FIG. 7 being a view from below and FIG. 8 being a view in cross-section taken along line VIII—VIII. In the illustrated embodiment of the diaphragm ring 37, eight recesses 39 are arranged uniformly around the periphery. The recesses 39 extend radially outwardly from the inner peripherally extending edge, on the underneath surface of the diaphragm ring, the outer downwardly disposed edge of the diaphragm ring 37 being maintained continuously.

Figure 9:
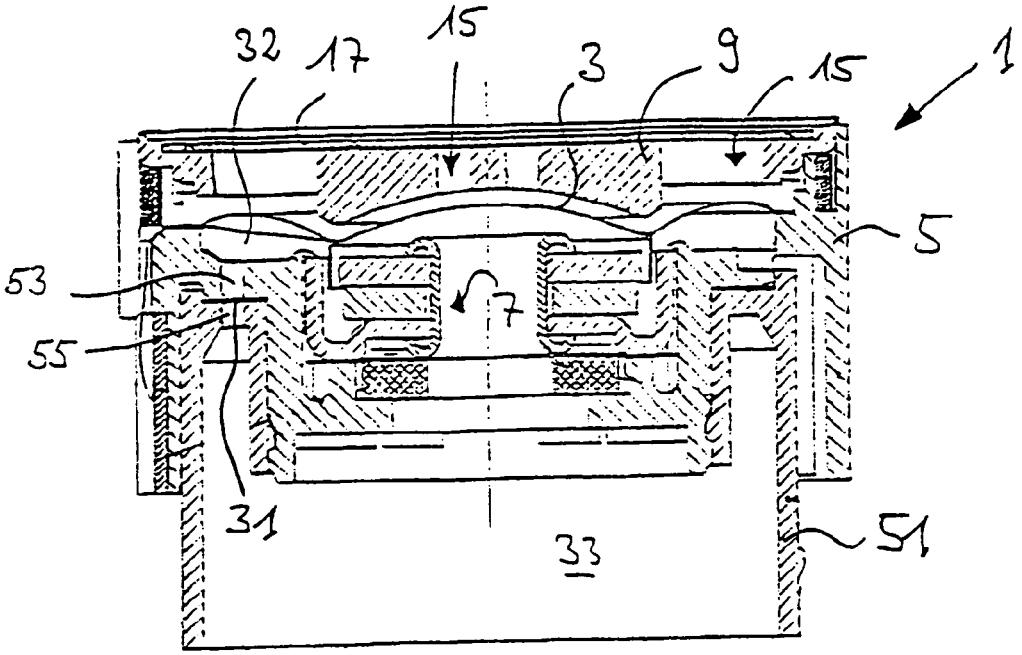
FIG. 9 shows a third embodiment of the microphone according to the invention.
Figure 10:
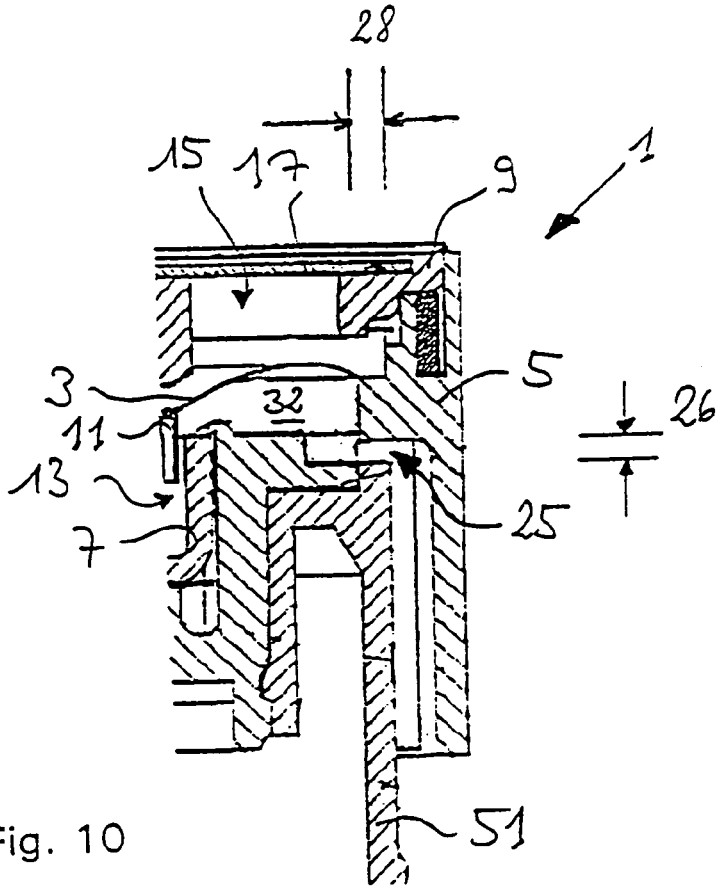
FIG. 10 shows a view on an enlarged scale of part of FIG. 9.

The microphone in a third embodiment which is shown as a view in cross-section in FIG. 9 and as a view on an enlarged scale in FIG. 10 has a separate casing portion 51 which is connected to the diaphragm fixing portion 5 and which substantially encloses the rear diaphragm surface. Also provided in the housing portion 51 is the cavity 33 which is connected by a sound passage provided with acoustic damping material 31, to the volume 32 connected through the rear diaphragm surface. In this case, the sound passage is formed by mutually oppositely disposed orifices 53 and 55 in the diaphragm fixing portion 5 and in the casing portion 51, wherein the acoustic material 31 is arranged and held between the diaphragm fixing portion 5 and the casing portion 51.

Formed between the diaphragm fixing portion 5 and the casing portion 51 is the slot-shaped sound inlet which represents the acoustic inductance. The height 26 (defined in the axial direction) and the length 28 of the slot-shaped sound inlet are predetermined by the diaphragm fixing portion 5 and/or the casing portion 51.

While the foregoing description and drawings represent the present invention, it will be obvious to those skilled in the art that various changes may be made therein without departing from the true spirit and scope of the present invention.

The invention claimed is:

1. A microphone comprising:

a diaphragm which has a first diaphragm surface which is oriented towards a sound source and on which sound waves impinge and a second diaphragm surface which is at least partly acoustically separated from the first diaphragm surface, and which faces away from the sound source;

at least one, slot-shaped sound inlet, through which sound waves can go to the second diaphragm surface and which forms substantially an acoustic inductance so that at least a part of the sound waves to be picked up is passed with a delay to the second diaphragm surface; and at least one damping element;

said sound inlet having an acoustic resistance which is less than the acoustic resistance of the damping element, wherein the sound waves to be picked up first pass through said at least one slot-shaped sound inlet before reaching said at least one damping element, wherein the diaphragm is connected to a diaphragm fixing portion, wherein the diaphragm fixing portion has an orifice which leads from a rear side of the microphone which faces away from a sound source to the second diaphragm surface and which is substantially closed by a sealing element, the slot-shaped sound inlet being formed between the sealing element and the diaphragm fixing portion.

2. The microphone as set forth in claim 1, wherein the damping element is formed by a sound passage which is provided with acoustic damping material and which connects a cavity to a volume delimited by the second diaphragm surface.

3. The microphone as set forth in claim 1, wherein the sound inlet is of a substantially rectangular cross section.

4. The microphone as set forth in claim 1, wherein the sound inlet comprises a diaphragm fixing portion which serves to carry the diaphragm.

5. The microphone as set forth in claim 1, wherein the sealing element comprises a porous material.

6. The microphone as set forth in claim 5, wherein the porous material is a sintered material.

7. The microphone as set forth in claim 1, wherein the cross section of the slit-shaped sound inlet is substantially formed by a recess in the diaphragm fixing portion, the length of the sound inlet being substantially predetermined by the thickness of the sealing element.

8. The microphone as set forth in claim 1, wherein the sealing element is substantially annular.

9. The microphone as set forth in claim 8, wherein the diaphragm fixing portion has an annular groove in which the sealing element is arranged.

10. The microphone as set forth in claim 8, wherein the cross section of the slit-shaped sound inlet is predetermined by the difference in size between an inside diameter of the diaphragm fixing portion and an outside diameter of the sealing element.

11. The microphone as set forth in claim 1, wherein the sealing element is in one piece with a closure element.

12. A microphone comprising:

a diaphragm which has a first diaphragm surface which is oriented towards a sound source and on which sound waves impinge and a second diaphragm surface which is at least partly acoustically separated from the first diaphragm surface, and which faces away from the sound source;

at least one, slot shaped sound inlet through which sound waves can go to the second diaphragm surface and which forms substantially an acoustic inductance so that least a part of the sound waves to be picked up is passed with a delay to the second diaphragm surface; and at least one damping element;

said sound inlet having an acoustic resistance which is less than the acoustic resistance of the damping element, wherein the sound waves to be picked up first pass through said at least one slot-shaped sound inlet before reaching said at least one damping element, wherein the diaphragm is connected to a diaphragm fixing portion, wherein the diaphragm fixing portion substantially encloses the second diaphragm surface and the sound inlet is formed between a holding portion on the diaphragm and the diaphragm fixing portion, wherein the holding portion is a diaphragm ring connected to the diaphragm, and, the slot-shaped sound inlet is formed substantially by recesses in the diaphragm ring.

13. The microphone as set forth in claim 12, wherein a casing portion which is connected to the diaphragm fixing portion and which substantially encloses the second diaphragm surface, the sound inlet being formed between the diaphragm fixing portion and the casing portion.

* * * * *

UNITED STATES PATENT AND TRADEMARK OFFICE

CERTIFICATE OF CORRECTION

PATENT NO. : 7,079,663 B1
APPLICATION NO. : 09/830756
DATED : July 18, 2006
INVENTOR(S) : Heinz Epping et al.

It is certified that error appears in the above-identified patent and that said Letters Patent is hereby corrected as shown below:

| | | | | | |
|---|---|---|---|---|---|
| Col. 8 | line 4 | change | “slit-shaped” | to | --slot-shaped-- |
| Col. 8 | line 14 | change | “slit-shaped” | to | --slot-shaped-- |
| Col. 8 | line 28 | change | “slot shaped” | to | --slot-shaped-- |
| Col. 8 | line 31 | insert | --at-- | before | least |

Signed and Sealed this

Nineteenth Day of December, 2006

JON W. DUDAS
*Director of the United States Patent and Trademark Office*

UNITED STATES PATENT AND TRADEMARK OFFICE

CERTIFICATE OF CORRECTION

PATENT NO. : 7,079,663 B1
APPLICATION NO. : 09/830756
DATED : July 18, 2006
INVENTOR(S) : Heinz Epping et al.

It is certified that error appears in the above-identified patent and that said Letters Patent is hereby corrected as shown below:

| | | | | | |
|---|---|---|---|---|---|
| Col. 8 | line 4 | change | “slit-shaped” | to | --slot-shaped-- |
| Col. 8 | line 14 | change | “slit-shaped” | to | --slot-shaped-- |
| Col. 8 | line 28 | change | “slot shaped” | to | --slot-shaped-- |
| Col. 8 | line 31 | insert | --at-- | before | least |

This certificate supersedes Certificate of Correction issued December 19, 2006.

Signed and Sealed this

Sixth Day of February, 2007

JON W. DUDAS
*Director of the United States Patent and Trademark Office*